US008028361B2

(12) United States Patent
Ramer et al.

(10) Patent No.: US 8,028,361 B2
(45) Date of Patent: Oct. 4, 2011

(54) INFANT SUPPORT DEVICE

(76) Inventors: Kevin Ramer, Stouffville (CA); Gabriela Ramer, Stouffville (CA)

( * ) Notice: Subject to any disclaimer, the term of this patent is extended or adjusted under 35 U.S.C. 154(b) by 0 days.

(21) Appl. No.: 12/544,808

(22) Filed: Aug. 20, 2009

(65) Prior Publication Data

US 2011/0041251 A1 Feb. 24, 2011

(51) Int. Cl.
*A47C 20/02* (2006.01)
*B68G 5/00* (2006.01)

(52) U.S. Cl. ..... 5/655; 5/603; 128/845; 128/846

(58) Field of Classification Search ..... 5/655, 648, 5/650; 128/845, 870, 871, 133; 297/377
See application file for complete search history.

(56) References Cited

U.S. PATENT DOCUMENTS

| | | | | |
|---|---|---|---|---|
| 2,646,735 | A * | 7/1953 | Zumbrunnen | 5/655 |
| 4,471,767 | A | 9/1984 | Guimond | |
| 4,566,449 | A * | 1/1986 | Smith | 5/655 |
| 5,046,750 | A | 9/1991 | Heubl | |
| 5,127,422 | A * | 7/1992 | Colon | 5/655 |
| 5,261,134 | A | 11/1993 | Matthews | |
| 5,524,640 | A * | 6/1996 | Lisak et al. | 5/655 |
| 5,546,620 | A | 8/1996 | Matthews | |
| 5,675,853 | A | 10/1997 | Linge | |
| D398,784 | S | 9/1998 | Koehl et al. | |
| 6,023,802 | A * | 2/2000 | King | 5/655 |
| 6,626,487 | B1 | 9/2003 | Buitendach | |
| D501,096 | S | 1/2005 | Desnos | |
| 7,117,553 | B2 | 10/2006 | Fairchild et al. | |
| D553,865 | S | 10/2007 | Buitendach | |
| D555,917 | S * | 11/2007 | Erli | D6/333 |
| 7,350,253 | B2 | 4/2008 | Simon | |
| 2002/0133881 | A1 | 9/2002 | Vrbas et al. | |
| 2006/0096031 | A1 | 5/2006 | Foster | |
| 2008/0092300 | A1 * | 4/2008 | Joe et al. | 5/655 |
| 2008/0178387 | A1 * | 7/2008 | Kachtick-Anders | 5/655 |

* cited by examiner

*Primary Examiner* — Robert G Santos
*Assistant Examiner* — Brittany Wilson
(74) *Attorney, Agent, or Firm* — Ivor M. Hughes; Neil H. Hughes; Marcelo K. Sarkis

(57) ABSTRACT

An infant support device for supporting an infant in a prone position, comprising a base with a front, a back, a top, a bottom and two side members, said base having a support surface extending between the side members on the top of the base;

the support surface being defined by two portions: (I) a body support surface disposed proximate the front of the support device and terminating adjacent the front of the device, and (II) a leg support surface extending rearwardly from terminus of the body support surface toward the back of the device;

and having a grip for retaining the posterior side of the legs of the infant and extending upwardly from the support surface between the side members;

wherein an infant is supported in a prone position on the support surface between the side members, and the legs are supported on the leg support surface and are retained by said grip to minimize infant rollover toward a supine position.

6 Claims, 18 Drawing Sheets

INFANT SUPPORT DEVICE

FIELD OF THE INVENTION

The present invention relates generally to baby products and more particularly to a device capable of retaining a baby in a prone position.

BACKGROUND OF THE INVENTION

It has been recommended by the Pediatric Society that infants and babies should always sleep on their backs and not in a prone position, to reduce the risk of Sudden Infant Death Syndrome (SIDS). However since the infants are kept for long periods of time on their backs, they can develop plagiocephaly or cranial disfiguration otherwise referred to as flattening of the back of the skull. Therefore, it was further recommended by pediatricians that babies need to spend time on their tummy known as "tummy time" in a prone position beginning at two months of age. Some suggest that "tummy time" has to be practiced from day one. Besides preventing cranial disfiguration, tummy time also promotes the development of muscular strength in the neck, back, shoulders and arms. Further it develops coordination, motor skills and head control required for rolling over and crawling.

Various baby products were developed in order to address the need for "tummy time" while reducing the involvement of the caregivers in the process. The requirements for those devices were to keep the baby in the prone position in a safe manner while preventing the baby from rolling on its back. It is also beneficial to raise the baby's head so the baby can observe the surroundings and not feel abandoned.

At some stage babies learn to turn onto their backs from the tummy position by using their head weight, making it difficult to keep them in the prone position for the required tummy time periods. Therefore it was still a need to provide a device to keep baby in the prone position and prevent rollover. The following patents illustrate various designs of support structures addressing the issue, however each of those designs has various deficiencies.

U.S. Pat. No. 4,566,449 issued to Smith teaches an elevated infant positioner restricting an infant's movement in lateral and vertical positions. However, this positioner does not prevent the infant from rolling over during the "tummy time" period.

U.S. Pat. No. 5,261,134 issued to Matthews, teaches a portable pillow for infant support. This pillow does not prevent an infant from rolling over to its back and further does not prevent the infant from sliding down from the pillow.

U.S. Pat. No. 5,675,853 issued to Linge, teaches an infant seat cushion comprising a foam cushion with an optional restraint for the infant. This device comprises several parts that make its operation cumbersome especially the restraining and the releasing functions.

U.S. Pat. No. 5,546,620 issued to Matthews, teaches a baby support comprising a mat and a cushion to support baby's chest in a prone position. This device, however, does not prevent baby from flipping over and from sliding down from the cushion.

U.S. Pat. No. 6,626,487 issued to Buitendach, teaches a baby chair that supports a baby in a seated position. This device however is not suitable for "tummy time" due to its design.

U.S. Pat. No. 7,117,553 issued to Fairchild et al., teaches an apparatus for support and development of an infant, comprising a mat with head and foot portions. This apparatus does not prevent the infant from rolling over and therefore the baby requires constant parent attention while utilizing this apparatus.

U.S. Patent Application No. 2002/0133881 to Vrbas et al., teaches an inclined pillow with fastening strips to hold a baby in supine or prone positions. This device positions a baby in a confusing awkwardly elevated position.

As it is apparent from a review of the prior art, there is still a need for simple and safe device for keeping a baby in a prone position.

It is therefore a primary object of the invention to provide a baby support device which is capable of retaining a baby in a prone position while preventing the baby from flipping over.

It is further an object of the invention to provide a device which is easy to operate without restraining straps.

It is still a further object of the invention to provide a device with inclined planes to keep baby's head elevated.

It is further an object of the invention to provide such a device made of a molding foam that is strong enough to restrain the baby and soft enough to be comfortable.

It is still a further object of the invention to provide such a device which is easy to clean and maintain.

Further and other object of the invention will become apparent to those skilled in the art when considering the following summery of the invention and the more detailed description of the preferred embodiment illustrated herein.

SUMMARY OF THE INVENTION

The purpose of the baby support device is to make the experience for the infant and the parents more enjoyable while providing adequate stomach time, to increase the necessary muscle stimulation concentrating mainly on the neck, upper body, arms and hands for future development and growth. This product will also help decrease the chances of the infant getting cranial asymmetry otherwise known as flattening of the baby's skull at the back of the head. This product is designed to cradle the infant on their stomach in a soft, non-toxic, environmentally friendly surrounding while laying on an incline with the infants head and upper body being at the higher end. There is also a leg grip which prevents the baby from sliding down from the original position and also restrains the legs and hips in such a way that the infant cannot roll over or out of the product.

The baby support device has been designed for children from birth to crawling age. The unique design enables babies to be propped up on their stomachs on an incline, which helps reduce the frustration babies incur during this learning experience. Once babies are able to roll over they do not spend any time on their tummies anymore and the support device of the invention allows them to spend time on their stomach without rolling over or getting out of it. Since they are propped up they are able to see the surrounding environment and play with toys.

It is therefore a primary aspect of the invention to provide an infant support device for supporting an infant in a prone position. The device comprises a base with a front, a back, a top, a bottom and two side members, said base having a support surface extending between the side members on the top of the base. The support surface is defined by two portions: (I) a body support surface disposed proximate the front of the support device and terminating adjacent the front of the device, and (II) a leg support surface extending rearwardly from the terminus of the body support surface toward the back of the device. The device further has a grip for retaining the posterior side of the legs of the infant and extending upwardly from the support surface between the side members. While in use, an infant is supported in a prone position on the support surface between the side members, and the legs of the infant are supported on the leg support surface and are retained by said grip to minimize infant rollover toward a supine position.

In another aspect of the invention there provided is the infant support device wherein the body support is inclined relative to the leg support surface and to the bottom of the base. Preferably the body support surface angle is more then 0 and less then 45 degrees, preferably 10 to 30 degrees relatively to the base. Further the leg support surface is also inclined and its angle is 0 to 30 degrees preferably 0 to 10 degrees relatively to the base. It is further preferable that the body support surface angle is 10 to 30 degrees and the leg support surface angle is 0 to 10 degrees.

Preferably the infant support device is made of a material safe for use with a baby, selected from: plastics, polymers, rubbers, resin, cork, wood, composite material or combinations thereof, suitable for supporting a baby. The device is preferably manufactured from soft yet supportive material. Preferably the material is plastic, polymer or polymer composite material. More preferably the baby support device is made of suitable polyurethane foams, low density polyurethane foams, EVA's (ethyl vinyl acetates), TPO's (polyolefins), TPR's (thermoplastic rubbers), TPU's (thermoplastic polyurethanes), PVC (polyvinyl chloride) or combinations thereof. Preferably the baby support device is made of a foam material having a hardness between 10-40 Asker C. Further preferably the foam material is selected from: EVA (ethyl vinyl acetate), TPO's (polyolefin), TPR's (thermoplastic rubber), TPU's (thermoplastic polyurethane), PVC (polyvinyl chloride) or a combinations thereof.

In another aspect of the invention the infant support device includes a grip being generally T shaped having an upper part and a lower part, wherein in use the infant's legs are inserted below the upper part of the leg grip while the lower part of the grip remains between the legs of an infant, wherein the grip prevents the infant from slipping down the support surface and from rolling over from the prone position.

In yet a further aspect of the invention for the infant support device, the side members are contoured inwardly to support the body of a baby. Further preferably the body support portion also has a depression capturing the tummy of a baby.

In yet a further aspect of the invention the infant support device is used for development of the muscles of the neck and upper body of a baby. The device may be also used for elimination or reduction of the effect of acid reflux in infants.

In still another aspect of the invention there is provided a method of developing neck, back, and arm muscles of a baby by positioning a baby in an one-piece infant support device for supporting an infant in a prone position, comprising a base with a front, a back, a top, a bottom and two side members, said base having a support surface extending between the side members on the top of the base. The support surface is defined by two portions: (I) a body support surface disposed proximate the front of the support device and terminating adjacent the front of the device, and (II) a leg support surface extending rearwardly from the terminus of the body support surface toward the back of the device. The body support is further inclined 10 to 30 degrees and the leg support is inclined 0 to 10 degrees. The device further comprises a grip for retaining the posterior side of the legs of the infant and extends upwardly from the support surface between the side members, wherein the grip is generally T shaped. In use the infant is supported in a prone position on the support surface between the side members, and the legs are retained on the leg support surface by the grip to minimize infant rollover toward a supine position. The support device is made of extruded foam material selected from: EVA (ethyl vinyl acetate), TPO's (polyolefin), TPR's (thermoplastic rubber), TPU's (thermoplastic polyurethane), PVC (polyvinyl chloride) or combinations thereof. Preferably the support device is made of extruded foam material comprising: EVA (ethyl vinyl acetate) and TPO's (polyolefin) with hardness of 10-40 Asker C. Most preferably the body support and the side members of the device are contoured to the body of an infant.

In yet a further aspect of the invention the baby support device is one-piece. The device further provides superior support and follows the natural contours of the body shape yet allows full range of movement of the mid and upper torso. This unique design eliminates the infant from falling or rolling out and eliminates sliding down the incline.

According to a primary aspect of the invention there is provided an infant support device for supporting an infant in a prone position, comprising a base with a front, a back, a top, a bottom and two side members, said base having a support surface extending between the side members on the top of the base; the support surface being defined by two portions: (I) a body support surface disposed proximate the front of the support device and terminating adjacent the front of the device, and (II) a leg support surface extending rearwardly from terminus of the body support surface toward the back of the device; and having a grip for retaining the posterior side of the legs of the infant and extending upwardly from the support surface between the side members;

wherein an infant is supported in a prone position on the support surface between the side members, and the legs are supported on the leg support surface and are retained by said grip to minimize infant rollover toward a supine position.

In another aspect of the invention, there is provided the infant support device wherein the body support surface is inclined relatively to the leg support surface and to the bottom of the base.

In another aspect of the invention, there is provided the device wherein the body support angle is more then 0 and less then 45 degrees, preferably 10 to 30 degree and the leg support angle is 0 to 30 degrees and preferably 0 to 10 degrees.

Preferably in the device the body support angle is 10 to 30 degrees and the leg support angle is 0 to 10 degrees.

In another aspect of the invention, there is provided the infant support device of wherein the grip is generally T shaped having an upper part and a lower part, wherein in use the infant's legs are inserted below the upper part of the legs grip while the lower part of the grip remains between the legs of an infant, wherein the grip prevents the infant from slipping down the support surface and from rolling over from the prone position.

In still another aspect of the invention the infant support device is made of a plastic, polymer, rubber, resin, cork, wood, composite material, or a combination thereof, suitable for supporting an infant.

Preferably the device is made of a foam material selected from: polyurethane foams, low density polyurethane foam, ethyl vinyl acetates, polyolefins, thermoplastic rubbers, thermoplastic polyurethanes, polyvinyl chloride or combinations thereof.

Preferably the infant support device is made of a material having a hardness between 10-40 Asker C.

In yet another aspect of the invention for the infant support device the side members are contoured inwardly to support the body of an infant.

In yet another aspect of the invention for the infant support device the body support portion further has a depression supporting the tummy of an infant.

Preferably the device is one-piece.

In still another aspect of the invention there is provided a method of developing neck, back, and arm muscles of an infant:

positioning an infant in an infant support device, comprising a base with a front, a back, a top, a bottom and two side members, said base having a support surface extending between the side members on the top of the base;

the support surface being defined by two portions: (I) a body support surface disposed proximate the front of the support device and terminating adjacent the front of the device, and (II) a leg support surface extending rearwardly from terminus of the body support surface toward the back of the device;

and having a grip for retaining the posterior side of the legs of the infant and extending upwardly from the support surface between the side members;

wherein an infant is supported in a prone position on the support surface between the side members, and the legs are supported on the leg support surface and are retained by said grip to minimize infant rollover toward a supine position.

In yet a further aspect of the invention there is provided the above mentioned method wherein the body support is inclined from 10 to 30 degrees and the leg support is inclined 0 to 10 degrees.

In yet a further aspect of the invention the support device of the above mentioned method is made of extruded foam material selected from: polyurethane foams, a low density polyurethane foam, ethyl vinyl acetates, polyolefins, thermoplastic rubbers, thermoplastic polyurethanes, polyvinyl chloride or combinations thereof.

Preferably the support device is made of extruded foam material comprising: EVA (ethyl vinyl acetate) and TPO's (polyolefin) with hardness of 10-40 Asker C.

In yet a further aspect of the invention there is provided the above mentioned method wherein the body support and the side members of the device are contoured to the body of an infant.

Preferably the device of the above mentioned method is one-piece.

In still another aspect of the invention there is provided a use of the infant support device for an elimination or reduction of the effect of acid reflux in infants.

In still another aspect of the invention there is provided an one-piece infant support device for supporting an infant in a prone position, comprising a base with a front, a back, a top, a bottom and two side members, said base having a support surface extending between the side members on the top of the base;

the support surface being defined by two portions: (I) a body support surface disposed proximate the front of the support device and terminating adjacent the front of the device, and (II) a leg support surface extending rearwardly from terminus of the body support surface toward the back of the device;

and having a grip for retaining the posterior side of the legs of the infant and extending upwardly from the support surface between the side members, wherein the grip is generally T shaped;

wherein the body support surface is inclined 10 to 30 degrees and the legs support surface is inclined 0 to 10 degrees;

the support device being made of extruded foam material comprising: EVA (ethyl vinyl acetate) and TPO's (polyolefin) with hardness of 10-40 Asker C;

the body support and the side members of the device being contoured to the body of an infant;

wherein an infant is supported in a prone position on the support surface between the side members, and the legs are retained on the leg support surface by said grip to minimize infant rollover toward a supine position.

Experts recommend about 30 minutes of tummy time a day for infants in order to help nurture and encourage fine and gross motor skills, especially those skills that lead to crawling. The device of this invention encourages babies to push up on their hands and arms and helps to develop strong shoulder, arm and hand muscles required for grasping and reaching.

Surprisingly, no other product on the market offers the stability and support to ensure the baby is not going to slide down, roll out or off of the product. Its unique design prevents these common mishaps. The one piece design makes it simple to manufacture and operate. The material is non-allergic, non-toxic and easy to clean.

DETAILED DESCRIPTION OF THE PREFERRED EMBODIMENTS

Figure 1:
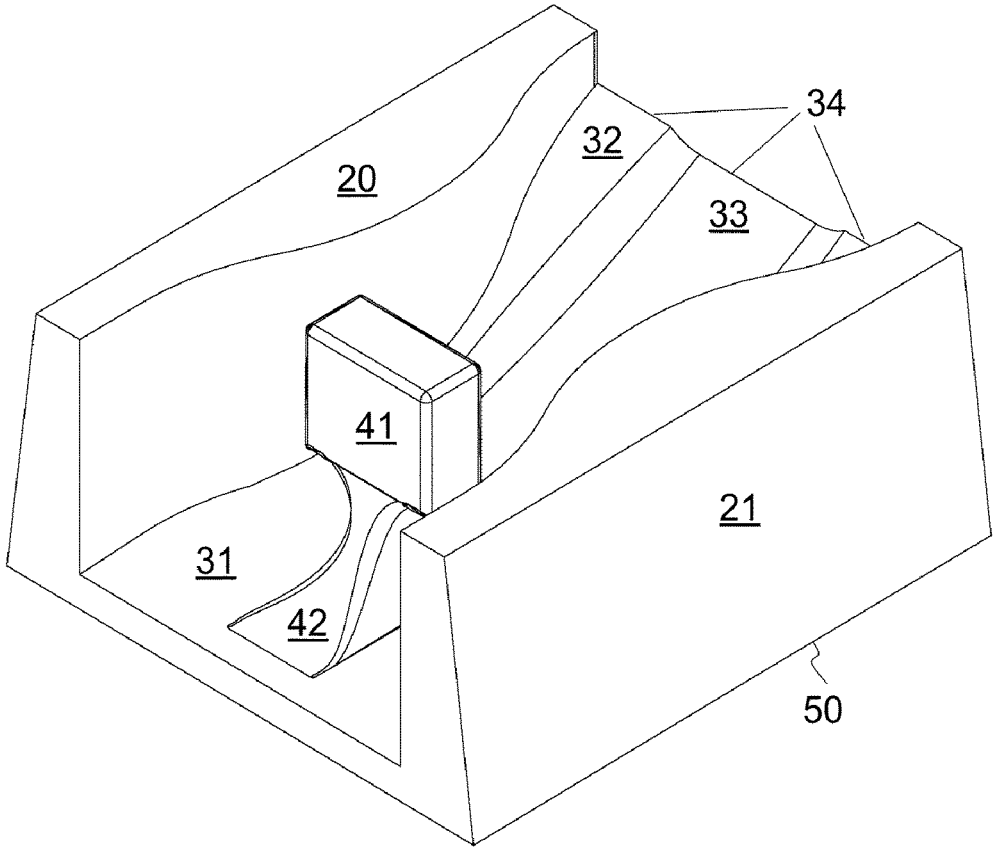
FIG. 1 illustrates a perspective view of the baby support device illustrated in a first embodiment of the invention.

Referring now to FIG. 1 there is shown a first embodiment for a baby support device including two side members 20 and 21, a leg grip 40 with an upper part 41 and a lower part 42, a support surface 30 including of two portions, the leg support portion 31 and the body support portion 32. The body support portion 32 also has a depression 33. The base 50 is wide enough to ensure stability of the device.

Figure 2:
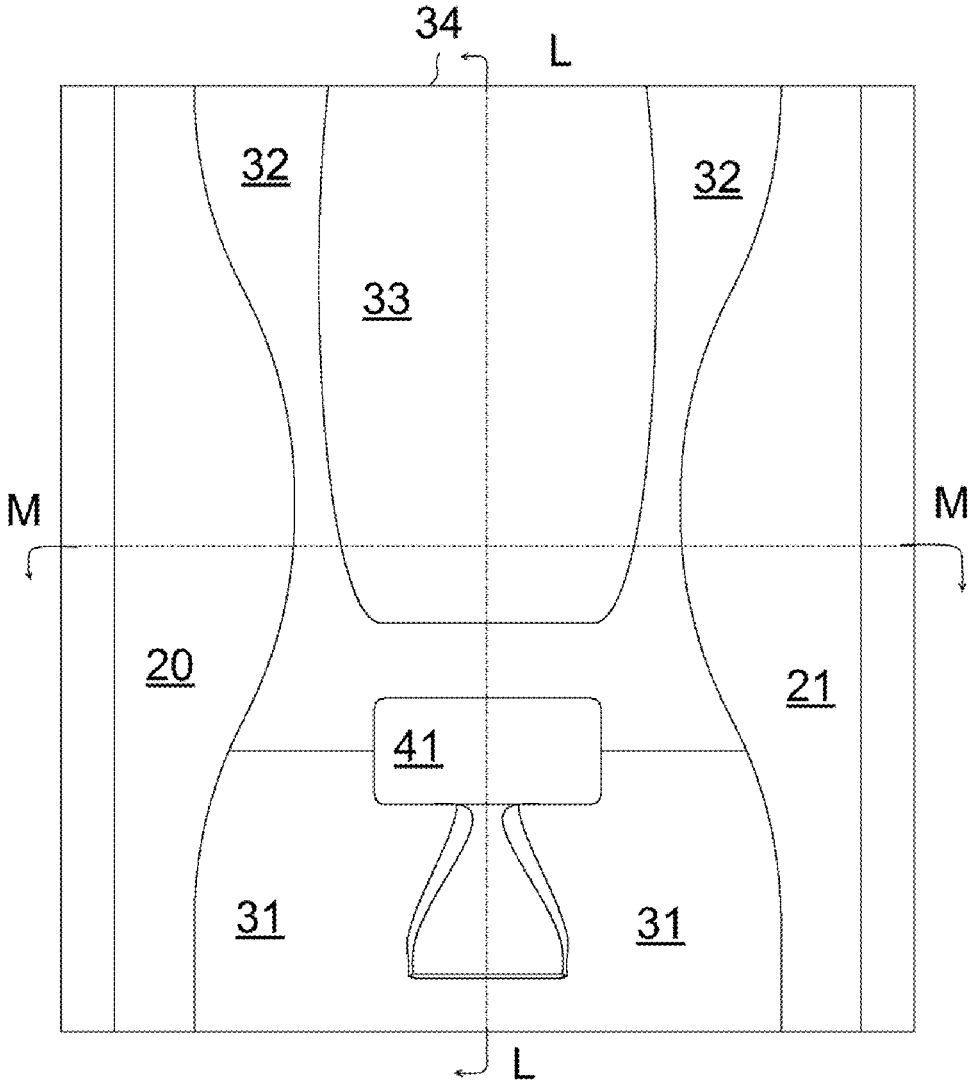
FIG. 2 illustrates the top view of the baby support device.

Referring now to FIG. 2 there is illustrated a top view of the baby support device which shows the depression 33, the support 30 and the side members 20 and 21. FIG. 2 illustrates the preferred embodiment of the invention while side members 20 and 21 are curved inwardly to ergonomically support the baby from each side while the leg grip 40 stops the baby from sliding down the incline of the support portion and also prevents the baby from rolling over.

Figure 3:
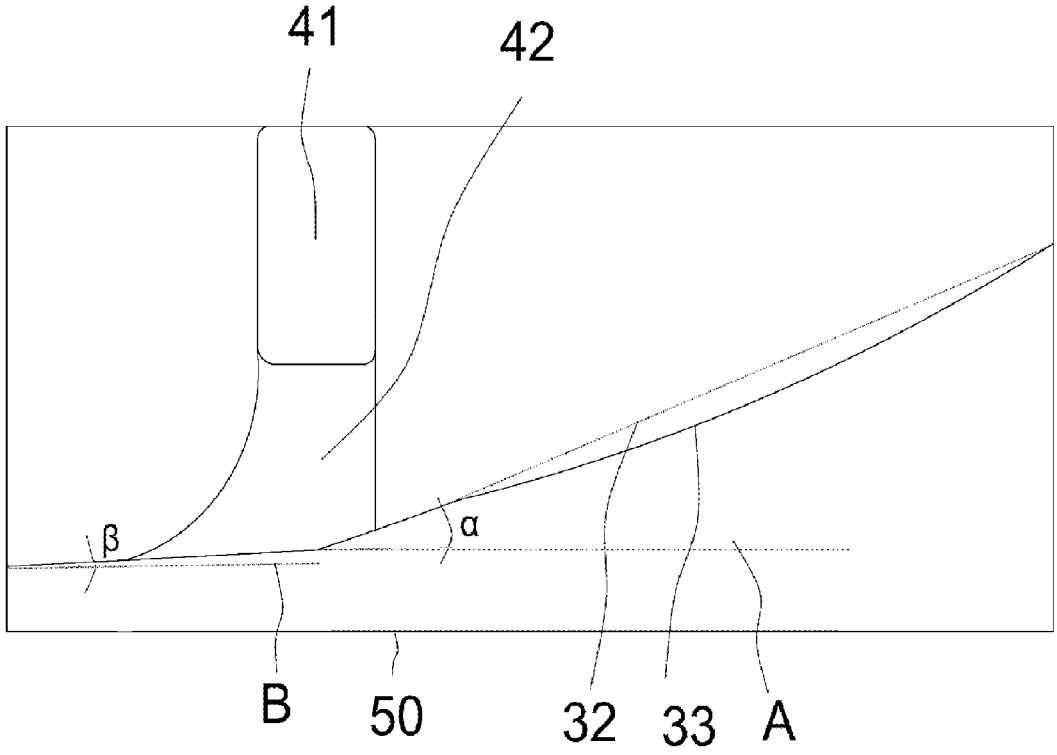
FIG. 3 illustrates the side view, cross section of the baby support device. The cross section is made through the line LL of FIG. 2.
Figure 4:
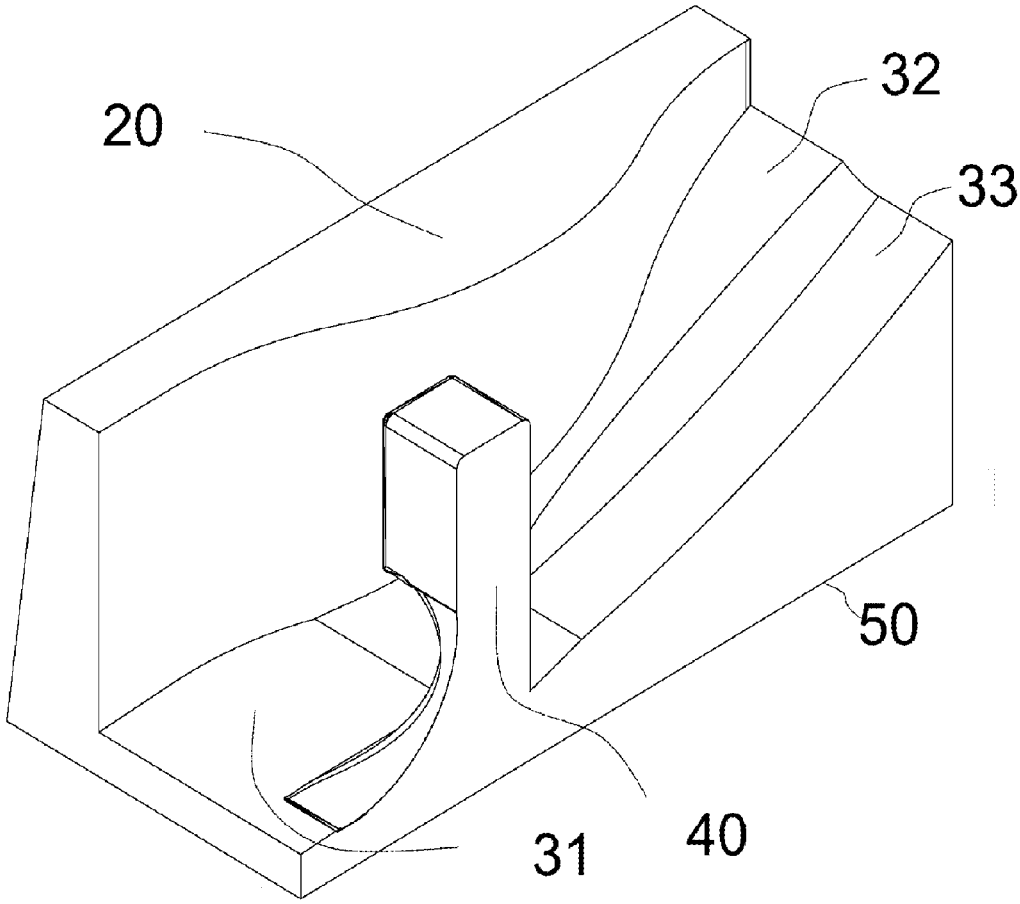
FIG. 4 illustrates the perspective side view of the baby support device in cross section, through the line LL of FIG. 2.

FIGS. 3 and 4 illustrates the cross section of the baby support device through its longitude and illustrates the position of the leg grip on the support device. In FIG. 3 two angles $\alpha$ and $\beta$ can be seen while $\alpha$ is the angle between the body support portion 32 to the base 50 and the angle $\beta$ is the angle of the leg support portion 31 to the base 50. Preferably angle $\alpha$ is equal to or greater than angle $\beta$. Angle $\alpha$ may vary from 0 to 45 degrees. In a preferred embodiment the angle is between 10 to 45 degrees and in a further preferred embodiment between 10 to 30 degrees. The angle $\beta$ may vary from 0 to 45 degrees and preferably from 0 to 10 degrees.

Figure 5:
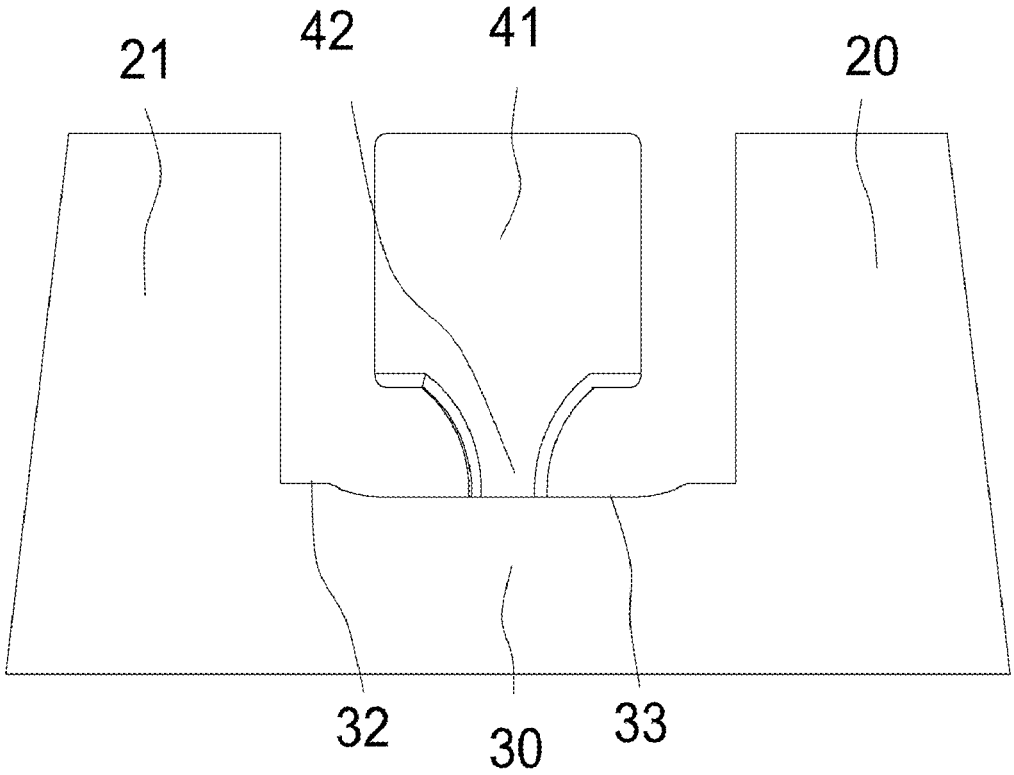
FIG. 5 illustrates the back view of the baby support device in cross section, through the line MM of FIG. 2.

FIG. 5 illustrates the cross section through the line LL of FIG. 2 and illustrates the position of the leg grip between the side members and also illustrates the beginning of the depression 33 on the body support portion 32.

Figure 6:
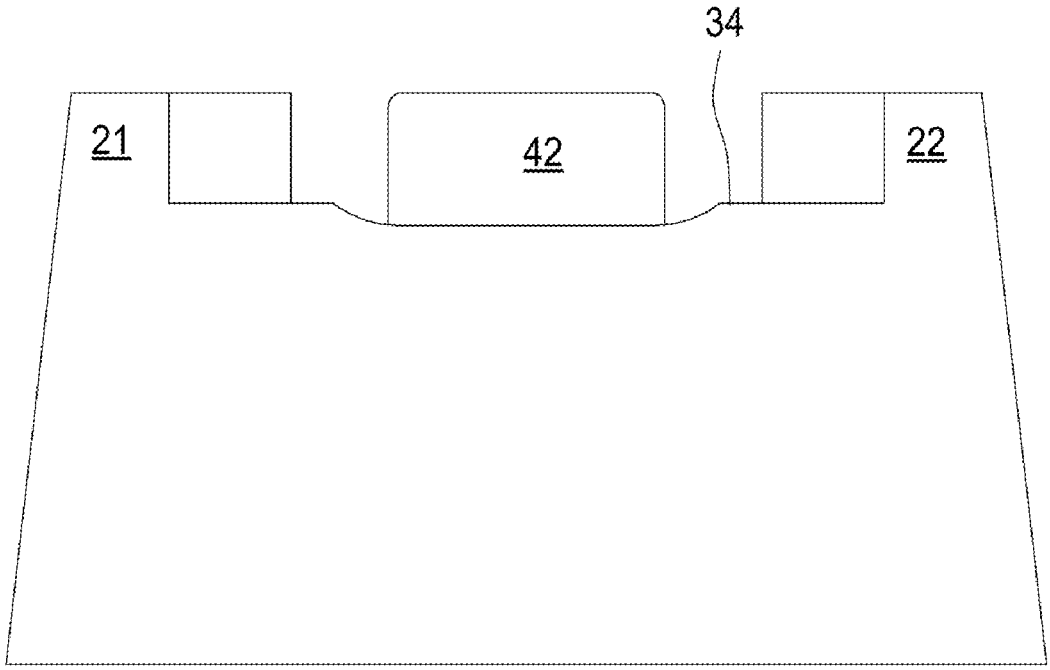
FIG. 6 illustrates the back view of the baby support device.
Figure 7:
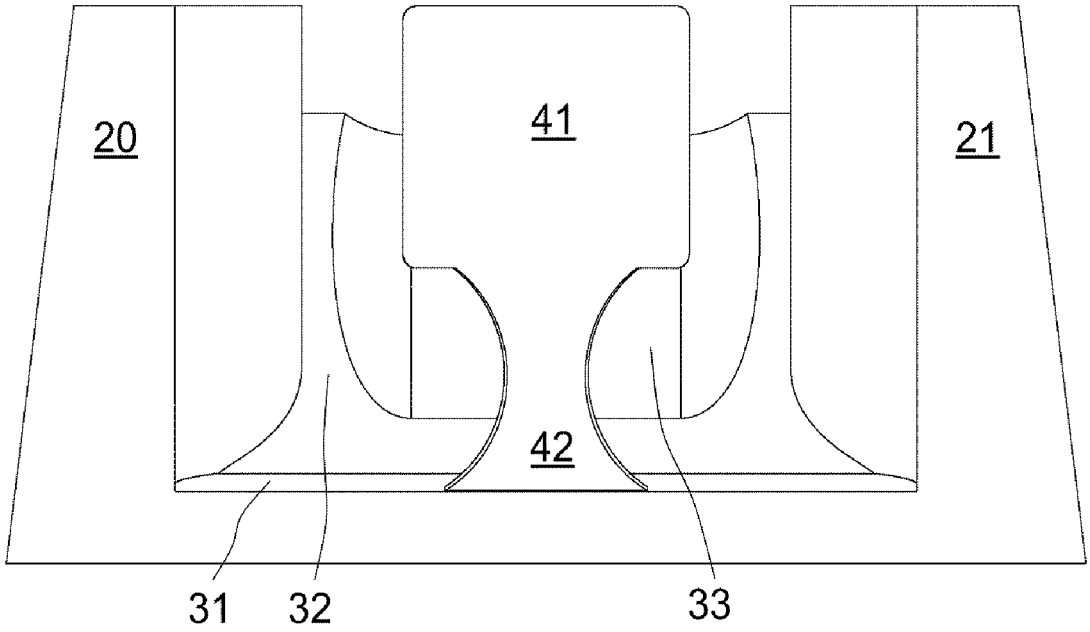
FIG. 7 illustrates the front view of the baby support device.
Figure 8:
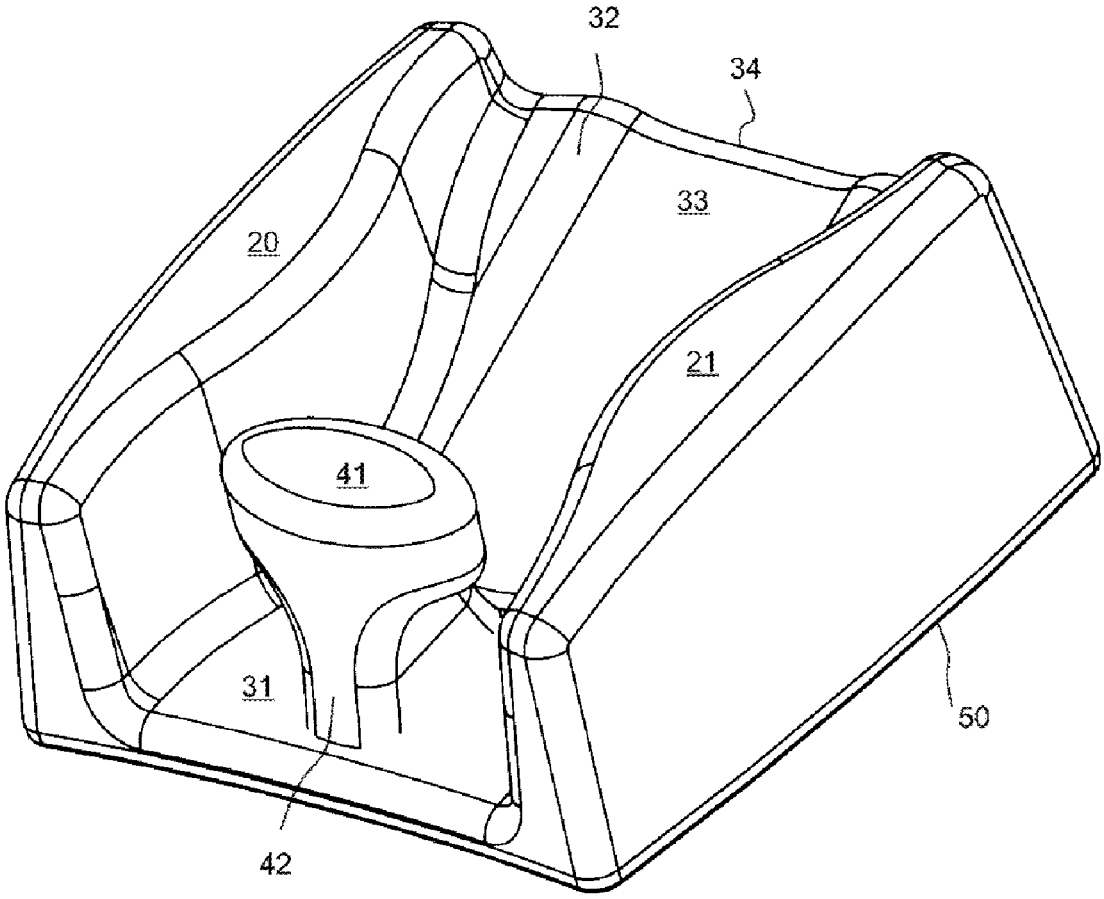
FIG. 8 illustrates a perspective view of the baby support device for a second embodiment of the invention.
Figure 9:
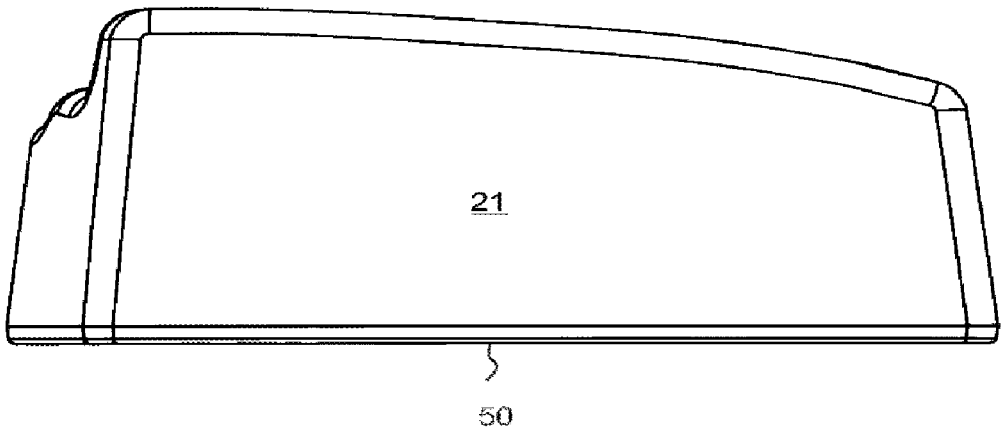
FIG. 9 illustrates the side view of the baby support device of the second embodiment of the invention.

FIG. 6 illustrates the front view of the baby support device. FIG. 7 illustrates the back view of the baby support device.

Figure 10:
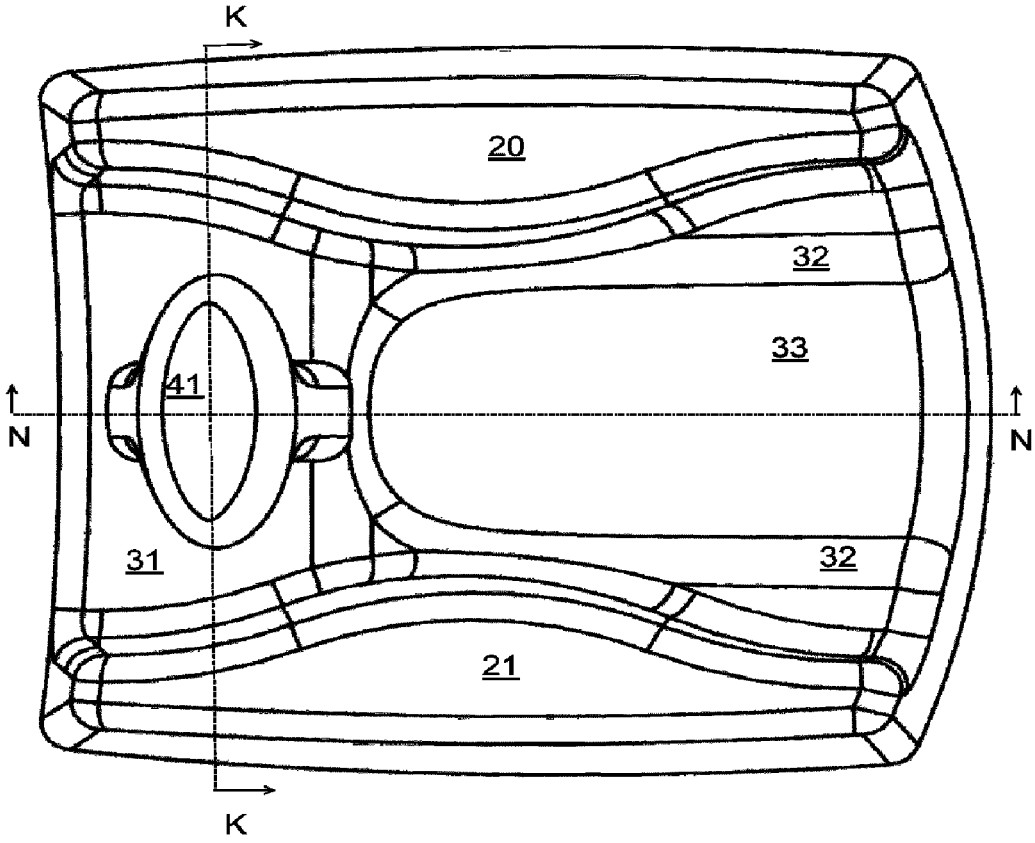
FIG. 10 illustrates the top view of the baby support device of the second embodiment of the invention.
Figure 11:
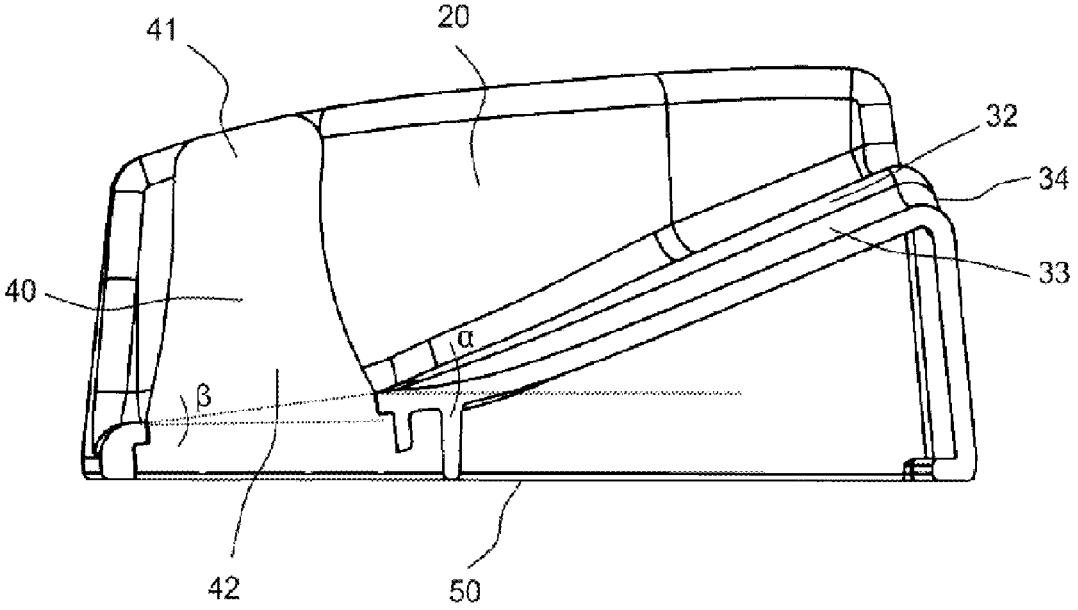
FIG. 11 illustrates the side view of the baby support device of the second embodiment of the invention shown in cross section, through the line KK of FIG. 10.
Figure 12:
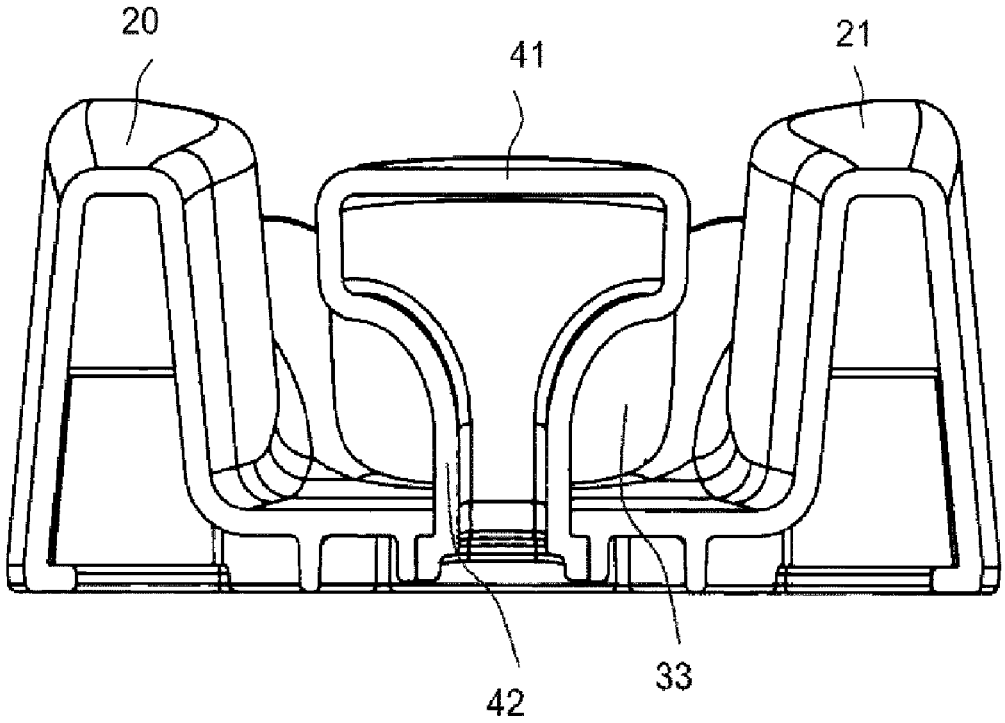
FIG. 12 illustrates the back view of the baby support device of the second embodiment of the invention shown in cross section, through the line NN of FIG. 10.
Figure 13:
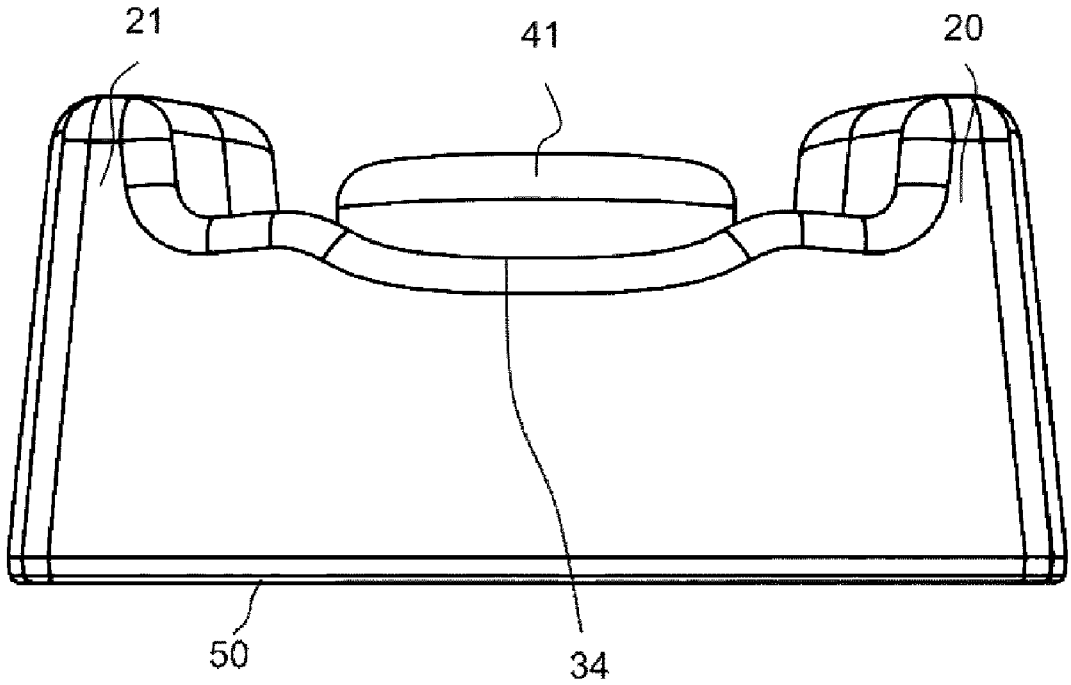
FIG. 13 illustrates the front view of the baby support device of the second embodiment of the invention.
Figure 14:
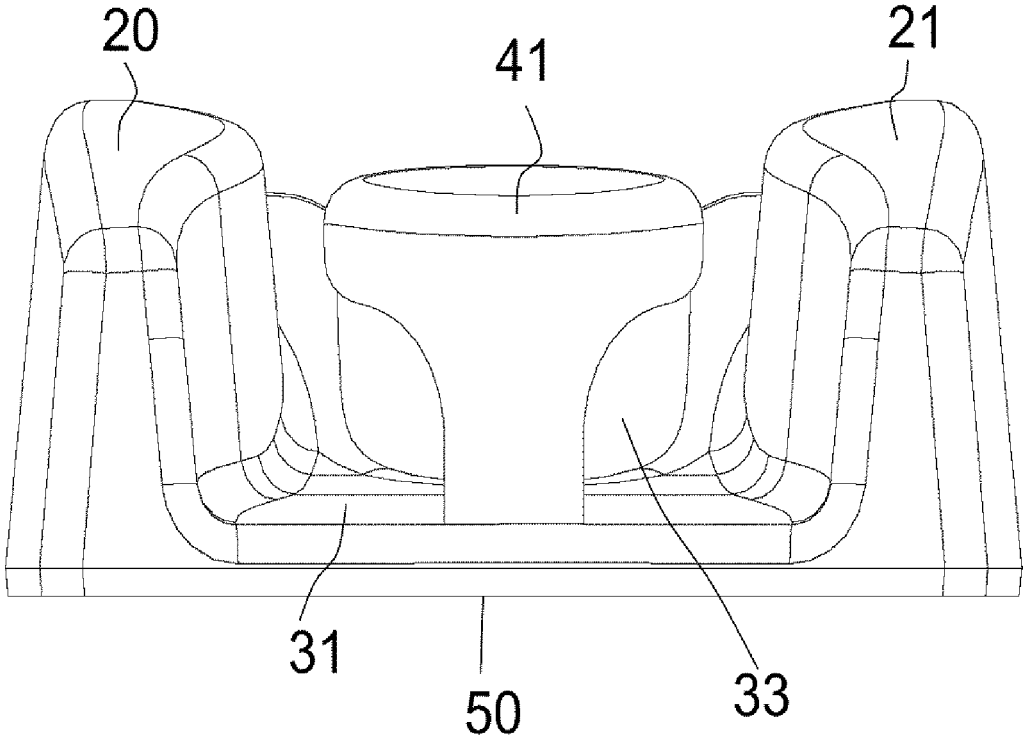
FIG. 14 illustrates the back view of the baby support device of the second embodiment of the invention.

FIGS. 8 to 14 illustrate a second embodiment of the invention wherein the baby support device is further shaped aesthetically, while maintaining all of the essential elements of the first embodiment of the device. FIG. 11 illustrates a cross sectional side view through line KK of the FIG. 10 and FIG. 12 illustrates the cross sectional view through line NN of the FIG. 10.

Figure 15:
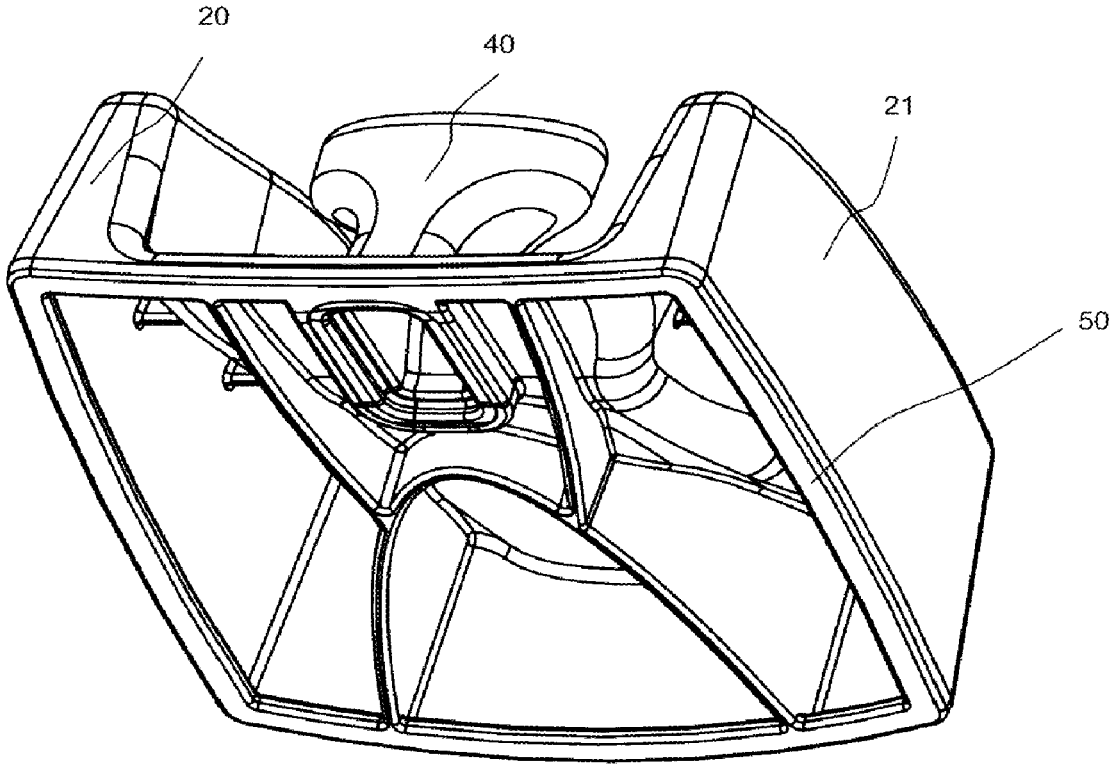
FIG. 15 illustrates the perspective bottom view of the baby support device of the second embodiment of the invention.
Figure 16:
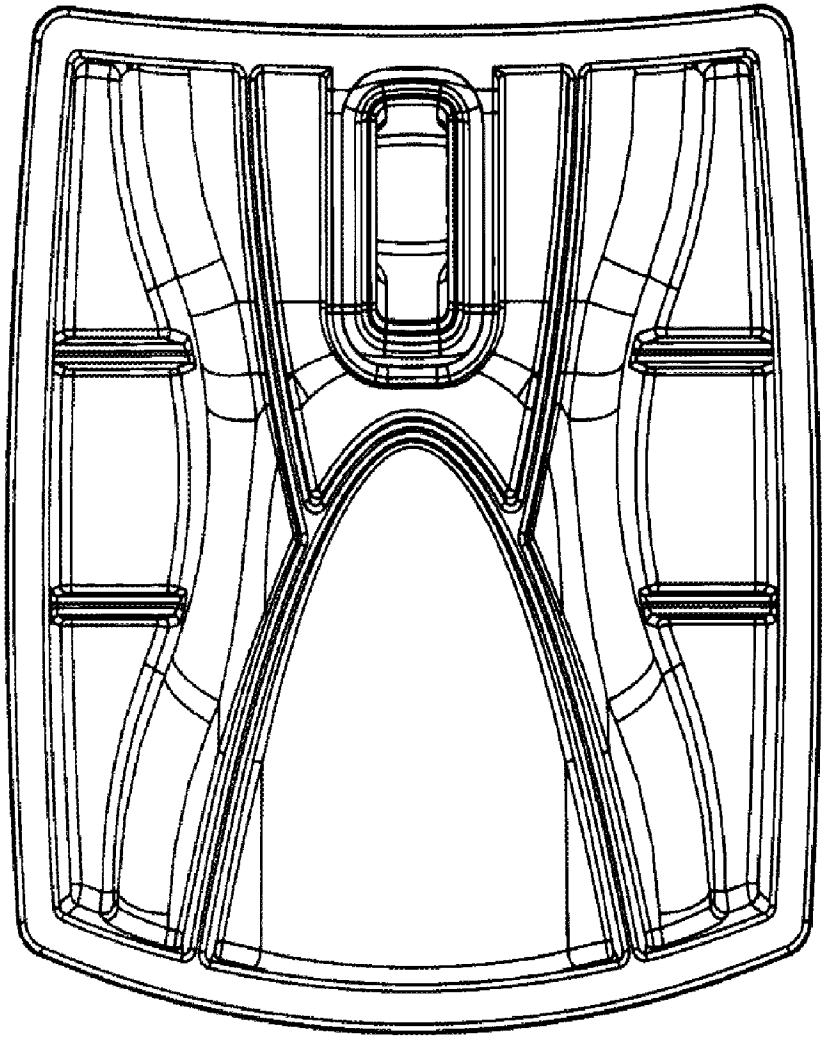
FIG. 16 illustrates the bottom view of the baby support device of the second embodiment of the invention.

FIGS. 15 and 16 illustrate a preferred embodiment of the invention wherein the inner part of the baby support device is partially void. This embodiment allows saving material required for manufacturing of the device while keeping the rigidity and stability of the structure. There are various ways known in the art for the preparation of polymer moulds with voids, therefore this embodiment of the bottom view of the device is provided here as a non limiting example. In yet another embodiments, the device can be manufactured without any voids at all at its bottom part.

Figure 17:
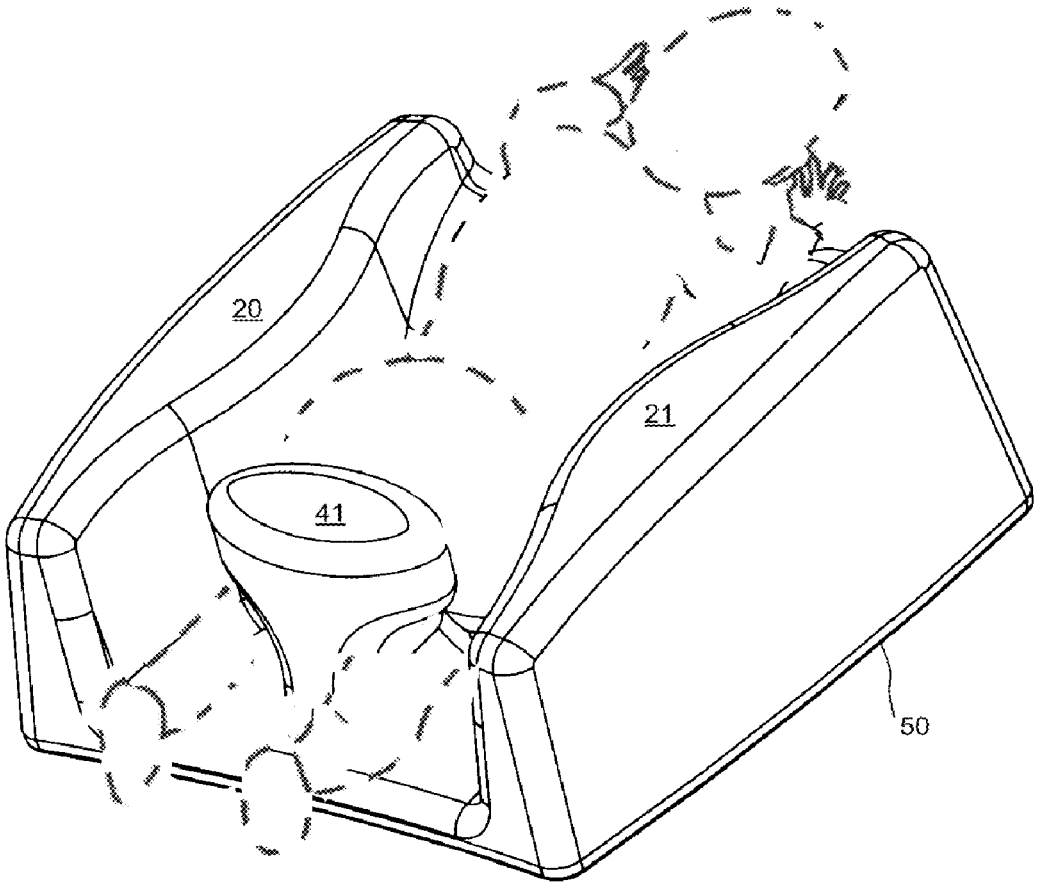
FIG. 17 illustrates the perspective view of the baby support device in use.
Figure 18:
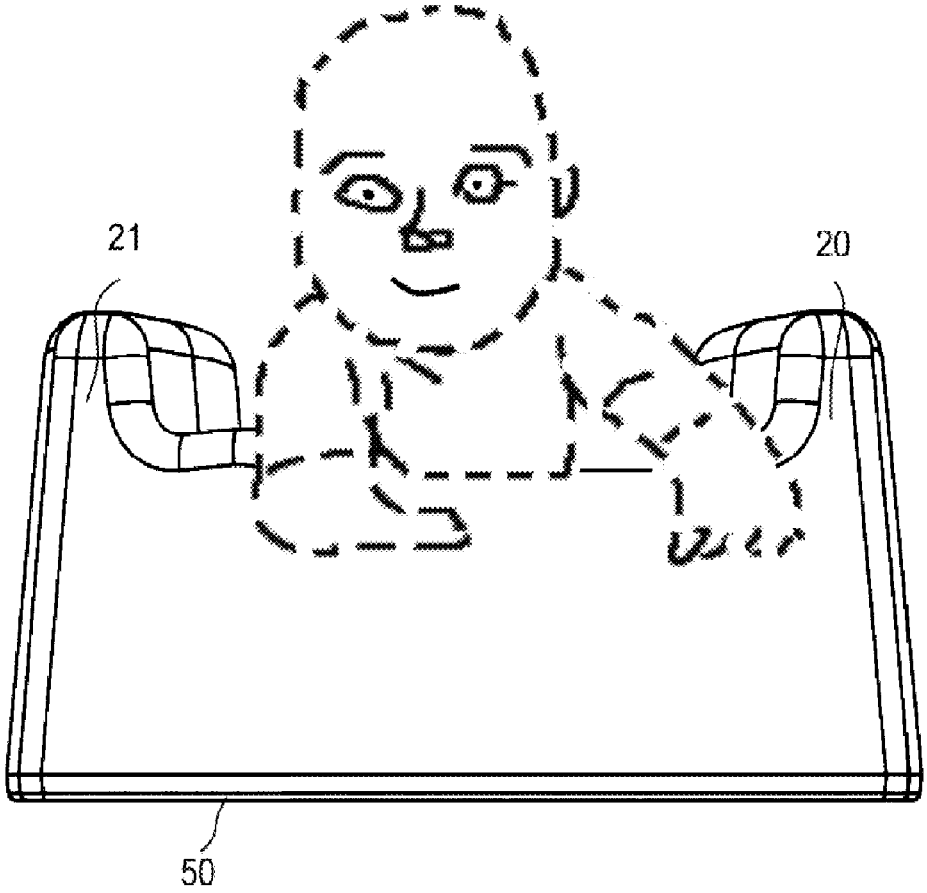
FIG. 18 illustrates the front view of the baby support device in use.

The use of the baby support device is apparent reading from the views of FIGS. 17 and 18. The baby is positioned as shown while its legs are inserted under the leg grip 40 wherein the left leg is positioned to the left of the lower part 42 of the leg grip 40. The right leg on the right side of the leg support while the upper part 41 of the leg grip is located above both legs of the baby. The upper part 41 of the leg grip 40 grips the posterior part of the feet, leg or thigh of the baby, depending on the size of the baby, and prevents the vertical or rotational movement of the baby, while still providing free range of movement and full body support. In this way the body of the baby is propped by the body support 32 with the baby's stomach is inside the depression 33. The head and the arms of the baby's body will rise above the front edge 34 of the body support portion 30 allowing the baby to observe its surroundings and also play with toys positioned in front of the baby.

The side members 20 and 21 have an ergonomic curvature that support the body of the baby providing more support and comfort. This design does not require any restraining straps or fasteners attached to the support device and provides the positioning of the baby and removal of the baby from the support device.

The baby is kept from rolling over by the leg grip 40 and specifically its upper part 41 that retains the legs in separated positions. Otherwise the baby is free to move and to use its arms and hands to play with toys beside the support device. Furthermore the baby can push itself above the front edge of the support device for developing its back, neck, arm and hand muscles.

The support device is made of baby friendly, non-toxic material preferably foam having a density for supporting and restraining an infant. The device preferably has a smooth outer skin to enable easy cleaning. The material may be selected from suitable plastics, polymers, resins, rubber, cork, wood or composite material or a combination thereof, polyurethane foams, a low density polyurethane foam, or other foams known in the art and typically used in baby's products which are non-toxic and environmentally friendly. Preferable types of material that can be used is a PopFoam™ material comprising EVA (ethylene-vinyl acetate) and TPO (thermoplastic polyolefin). The foam may be produced by an injection molding process preferably by injection molding with micro cell cross linking agents. The material must be approved for safe use with babies and infants.

The dimensions of the unit is fitted to the range size of infants but preferably the width of the support device is 10 to 20 inches, the length is 10 to 25 inches and the height is between 4 and 12 inches. The slope of the body support is between 0 to 45 degrees and the slope of the leg support is between 0 to 30 degrees. The distance of the narrowest part of the side members is between 5 to 15 inches and the narrowest distance between the leg support and the side members is between 1 to 6 inches.

In yet another embodiment of the invention (not shown) the upper part 41 of the leg grip 40 may extend toward the side members 20 and 21 or be attached to ether one or both side members.

The following lists some further features of the invention and its benefits over the current products on the market. The product of the invention is preferably an one-piece device, while other products on the market are designed with multiple parts and pieces and seem to be bigger and bulkier.

The unique design of the leg grip prevents downward movement or any rolling out of the unit while the baby still has free range of movement and full support. None of the products on the market offer this type of leg grip.

Several devices on the market use some type of strap, belt or restraint which would impose more restrictions of movement than the current device which does not require any strap attachments but still prevents any undesirable movement yet provides full range of motion.

Some products provide improper and awkward positioning of the baby according to the design. The device of the invention is streamlined and follows the natural contours of the body providing comfortable positioning of a baby. Some known designs impede or restrict movement and motion needed to promote proper development of the baby while the design of the current invention does not restrict the movement of the upper body of a baby promoting the development of the upper body muscles.

The preferred material is PopFoam™. The basic composition of the material to be used in the product is EVA ("ethylene-vinyl acetate")/TPO ("thermoplastic polyolefin"). The process is defined as injection molding foam with micro cell cross linking agents. The material of the whole product is soft and comforting to the touch. The hardness/durometer of the material is 10-45 Asker C preferably 30 to 40 Asker C measured by the method ASTM D-2240. This makes it very safe for the infant and comforting to the parents. It cleans easily and can be wiped off. No removable cover or sheet is needed. The material is preferably non-toxic and is specially formulated to be antibacterial. Preferably all the edges of the device are soft and rounded so there are no sharp edges or corners to hurt the baby or the parent.

The product can help infants with cranial asymmetry and can be used to avoid this flattening of the back of the head by using daily. Primarily this condition is caused because the infants spend the majority of the first few months on their backs. This problem could be related to SIDS where according to the American Academy of Pediatrics and Canadian Pediatric Society the safest position for the infant to sleep is on their backs, which in early months of the baby could be up to 18 hrs or more per day.

The baby supporting device is also very effective for promoting and helping develop strength in the hands, arms, shoulders, neck and back. It encourages babies to push up with their arms and it allows the babies to see the surrounding environment and interact. It also helps to develop fine and gross motor skills that are both essential and necessary for growth and proper development. Not enough time on the stomach can delay these skills and over time can lead to serious issues. The device helps to eliminate the frustration infants encounter for tummy time by positioning them in this incline.

Further the device of the invention can also help eliminate or reduce the effects of acid reflux in infants.

Various attachment may be added later to the final product. For example it would be possible to add a removable "u" shaped arm with toys allowing the infant to play with toys on the u shaped arm or on the ground in front of the product.

It will be further understood that there are details of the present disclosure which may be changed without departing from the scope of the invention. The foregoing description is for the purpose of illustration only and not for the purpose of limitation.

The embodiments of the invention in which an exclusive property or privilege is claimed are as follows:

1. A method of developing neck, back, and arm muscles of an infant, the method comprising:

positioning an infant in an infant support device, comprising a base with a front, a back, a top, a bottom and two side members, said base having a support surface extending between the side members on the top of the base;

the support surface being defined by two portions: (I) a body support surface disposed proximate the front of the support device and terminating adjacent the front of the device, and (II) a leg support surface extending rearwardly from terminus of the body support surface toward the back of the device;

and having a grip for retaining the posterior side of the legs of the infant and extending upwardly from the support surface between the side members;

wherein an infant is supported in a prone position on the support surface between the side members, and the legs are supported on the leg support surface and are retained by said grip to minimize infant rollover toward a supine position.

2. The method of claim 1 wherein the body support is inclined from 10 to 30 degrees and the leg support is inclined 0 to 10 degrees.

3. The method of claim 2 wherein the support device is made of extruded foam material selected from: polyurethane foams, a low density polyurethane foam, ethyl vinyl acetates, polyolefins, thermoplastic rubbers, thermoplastic polyurethanes, polyvinyl chloride or combinations thereof.

4. The method of claim 3 wherein the support device is made of extruded foam material comprising: EVA (ethyl vinyl acetate) and TPO's (polyolefin) with hardness of 10-40 Asker C.

5. The method of claim 4 wherein the body support and the side members of the device are contoured to the body of an infant.

6. The method of claim 5 therein the device is one-piece.

* * * * *